US006935290B2

(12) United States Patent
Jiang

(10) Patent No.: US 6,935,290 B2
(45) Date of Patent: Aug. 30, 2005

(54) AVOID DRAWING AIR INTO VCT CHAMBER BY EXHAUSTING OIL INTO AN OIL RING

(75) Inventor: Zhenyu Jiang, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/891,225

(22) Filed: Jul. 14, 2004

(65) Prior Publication Data

US 2005/0028771 A1 Feb. 10, 2005

Related U.S. Application Data

(60) Provisional application No. 60/492,364, filed on Aug. 4, 2003.

(51) Int. Cl.[7] ..... F01L 1/34

(52) U.S. Cl. ..... 123/90.17; 123/90.12; 123/90.15; 123/90.16; 123/90.18; 464/160; 137/625.34; 137/625.35

(58) Field of Search ..... 123/90.17, 90.12, 123/625.34, 625.35; 137/625.34, 625.35

(56) References Cited

U.S. PATENT DOCUMENTS 5,367,992 A * 11/1994 Butterfield et al. ..... 123/90.17
5,803,029 A 9/1998 Yoshihara et al. ..... 123/90.16
6,035,819 A 3/2000 Nakayoshi et al. ..... 123/90.17
6,739,293 B2 * 5/2004 Turner et al. ..... 123/90.12

FOREIGN PATENT DOCUMENTS

JP 6093815 A2 4/1994 ..... F01L/1/34
JP 07-224616 8/1995 ..... F01L/1/34

* cited by examiner

*Primary Examiner*—Thomas Denion
*Assistant Examiner*—Kyle M. Riddle
(74) *Attorney, Agent, or Firm*—Brown & Michaels, PC; Greg Dziegielewski

(57) ABSTRACT

A VCT phaser for an internal combustion engine with at least one camshaft comprising a housing, a rotor, a spool valve and a ring-shaped reservoir. The housing having at least one chamber and the rotor having at least one vane dividing the chambers into advance and retard. The spool valve is comprised of a spool mounted within a bore of the rotor. The reservoir is defined within the bore by an oil dam and at least one of the spool lands. The spool has a first position in which a chamber is coupled to the supply and the other chamber is exhausting fluid and a second position in which a chamber is coupled to the supply and the other chamber is coupled to the reservoir. When a torque reversal occurs, hydraulic fluid pooled in the reservoir is drawn into the other chamber when the spool is in the second position.

20 Claims, 10 Drawing Sheets

AVOID DRAWING AIR INTO VCT CHAMBER BY EXHAUSTING OIL INTO AN OIL RING

REFERENCE TO RELATED APPLICATIONS

This application claims an invention, which was disclosed in Provisional Application No. 60/492,364, filed Aug. 8, 2003, entitled "Avoid Drawing Air Into VCT Chamber By Exhausting Oil Into An Oil Ring." The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing systems. More particularly, the invention pertains to a variable cam timing system having a reservoir of pooled oil to prevent air from entering the chambers of the phaser.

2. Description of Related Art

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In any of the multiple-camshaft engines, it will be understood that there would be one phaser on each camshaft, as is known to the art.

FIGS. 1A and 1B show a conventional oil pressure actuated phaser. In an oil pressure actuated (OPA) phaser, engine oil pressure is applied to a chamber 2, 12 on one side of the vane 6 or the other. Oil from the opposing chamber 2, 12 is exhausted back to the oil sump through lines 8, 10. The applied engine oil pressure alone is used to move the vane 6 in the advancing or retarding direction. Engine oil to the chambers 2, 12 is controlled by a centrally located spool valve 4. The spool valve 4 is comprised of a spool 9 with cylindrical lands 9*a*, 9*b* and is surrounded by a cylindrical sleeve 13. The spool 9 is biased by a spring on one side and actuator on the other side (not shown).

FIG. 1A shows the OPA phaser in an advance position when torque reversals are not present. Oil 5 flows from the retard chamber 12 through line 10 and out to the oil sump (not shown). Supply 18 provides oil 5 to the advance chamber 2 through line 8.

FIG. 1B shows the OPA phaser advancing when torque reversals 20 are present. Oil 5 is fed from the supply 18 to the advancing chamber 2 through line 8, moving the vane 6 in the direction shown by the arrow. Oil 5 exits the retard chamber 12 through line 10. When a torque reversal 20 occurs air 19 within the cylindrical sleeve 13 housing the spool 9, is drawn into line 10 by a vacuum created by the torque reversal 20. The air 19 travels through line 10 to the retard chamber 12 and eventually accumulates in the chamber 12 to a point where severe aeration occurs and the phaser experiences a large amount of oscillation and may totally lose its phasing capability. The same accumulation may occur when the phaser was retarding.

The accumulation of air in the chambers as described above would also occur in a single check valve torsion assist (TA) phaser or a two check valve torsion assist (TA) phaser.

Various patents have tried to decrease or prevent air from entering the hydraulic chambers. U.S. Pat. No. 5,803,029 discloses a helical spline phaser where torque fluctuations are dampened between the camshaft and pulleys by the oil retained in the delay hydraulic chamber and the advance chamber. When changing cams, the first and second oil lines of the control valve are shut off to the advance and delay oil passages. All of the oil discharged from the oil pump is fed to the valve lift control mechanism.

JP6093815A2 discloses discharge ports that communicate with an oil discharge preventing passage, which extends above the hydraulic chamber. The position of the discharge preventing passage above the hydraulic chamber air is prevented from flowing into the hydraulic chamber.

JP07224616 discloses helical spline phaser in which a ring gear present between the timing pulley housing and the camshaft that prevents air from entering the advance or retard chamber in which oil is not present.

SUMMARY OF THE INVENTION

A variable cam timing (VCT) phaser for an internal combustion engine with at least one camshaft comprising a housing, a rotor, a spool valve and a ring-shaped reservoir. The housing has an outer circumference for accepting drive force and has at least one chamber. The rotor connects to a camshaft coaxially located within the housing and has at least one vane dividing the chambers into advance and retard. The spool valve is comprised of a spool having a plurality of lands slidably mounted within a bore of the rotor. The ring-shaped reservoir is defined within the bore by an oil dam and at least one of the spool lands. The spool has a first position in which the advance chamber or the retard chamber is in fluid communication with the supply of hydraulic fluid and the other chamber is exhausting hydraulic fluid and a second position in which the advance chamber or the retard chamber is in fluid communication with the supply of hydraulic fluid and the other chamber is in fluid communication with the reservoir. When a torque reversal occurs, hydraulic fluid pooled in the ring-shapes reservoir is drawn into the advance chamber or retard chamber when the spool is in the second position.

DETAILED DESCRIPTION OF THE INVENTION

Figure 1A:
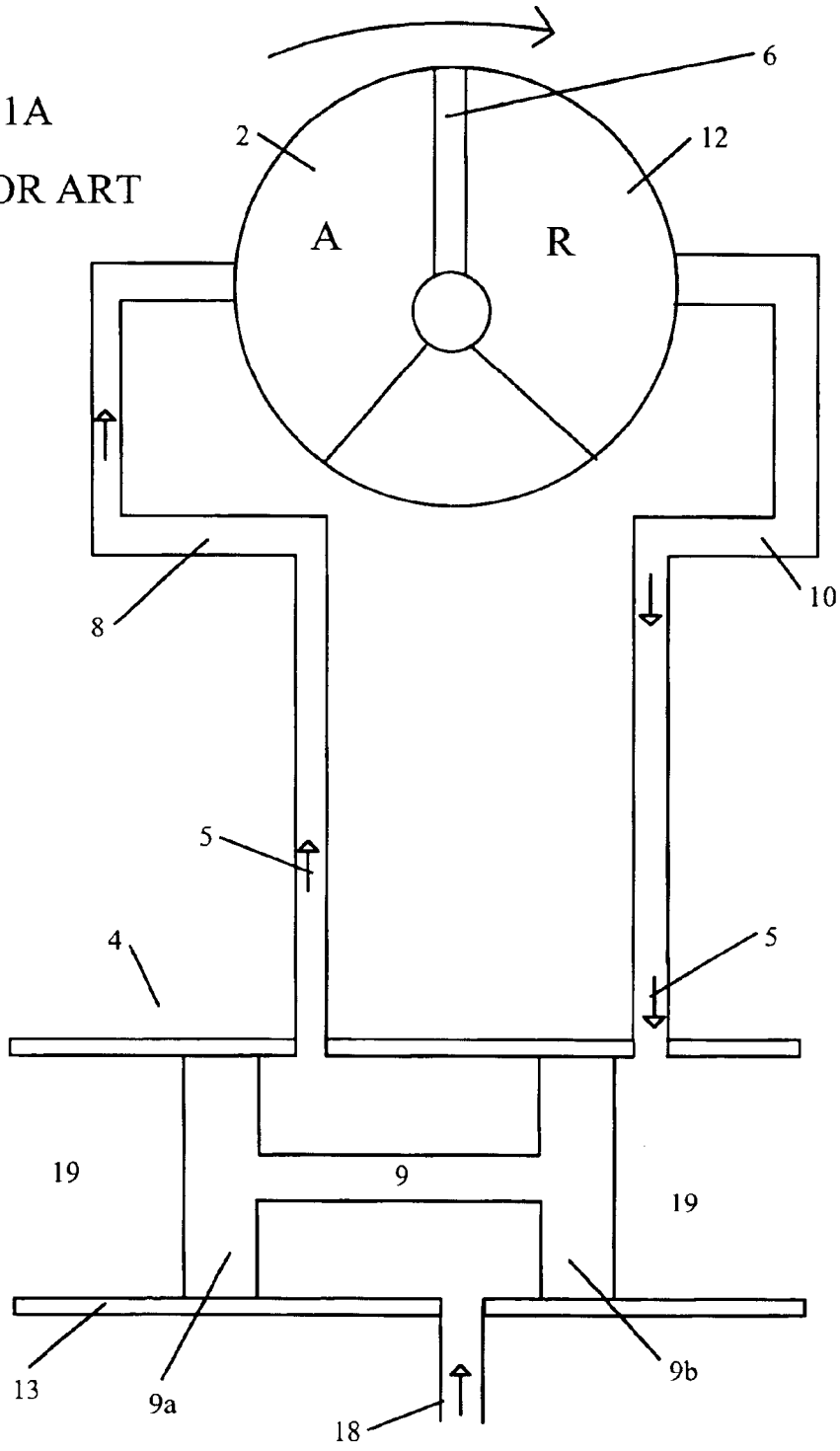
Fig. 1A PRIOR ART
FIG. 1A shows a conventional oil pressure actuated (OPA) phaser in the advance position.
Figure 1B:
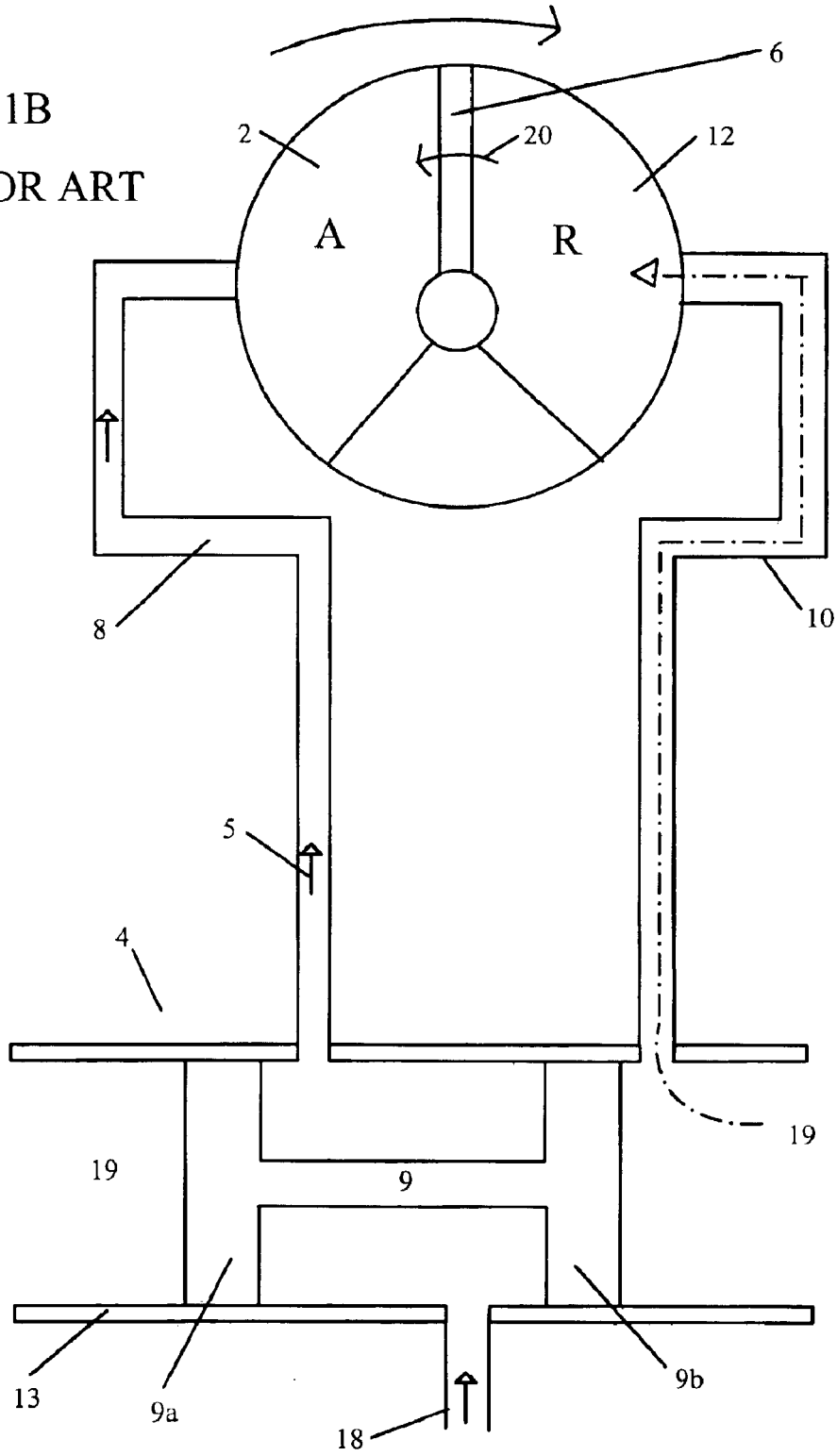
Fig. 1B PRIOR ART
FIG. 1B shows a conventional oil pressure actuated (OPA) in the advance position when torque reversals occur.
Figure 2:
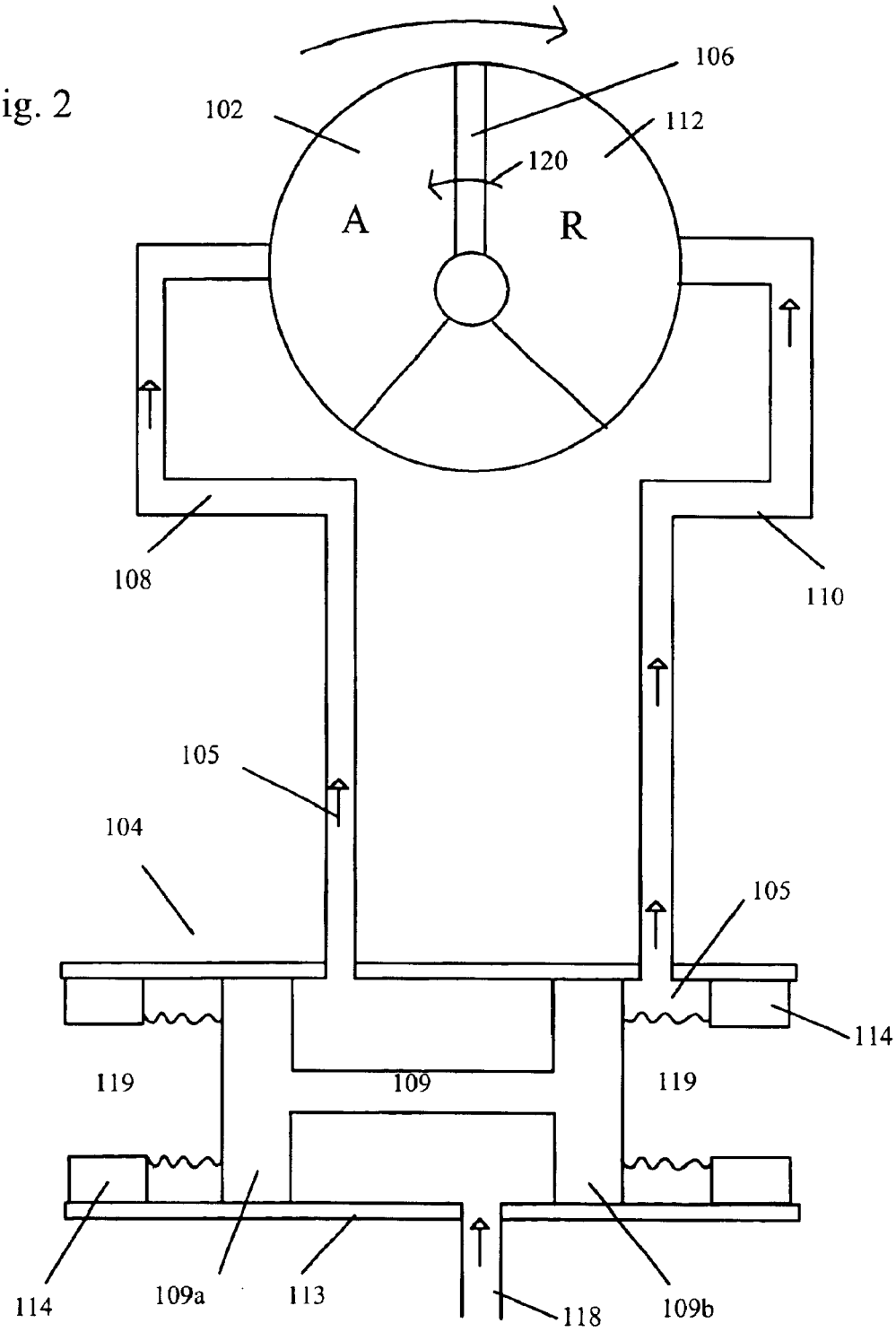
FIG. 2 shows a schematic of a phaser of first embodiment.

FIG. 2 shows an oil pressure actuated (OPA) phaser of a first embodiment in the advance position. Supply line 118 provides oil 105 to line 108, which leads to advance chamber 102, and moves vane 106 in the direction shown by the arrow. The chambers 102, 112 are defined by the housing and the rotor (not shown). Hydraulic fluid 105, which may be oil, exits from the retard chamber 112 through line 110 to the spool valve 104. The spool valve 104 is comprised of a spool 109 and cylindrical lands 109*a* and 109*b*. The spool 104 is biased on one side by a spring and an actuator on the other side (not shown).

Figure 3:
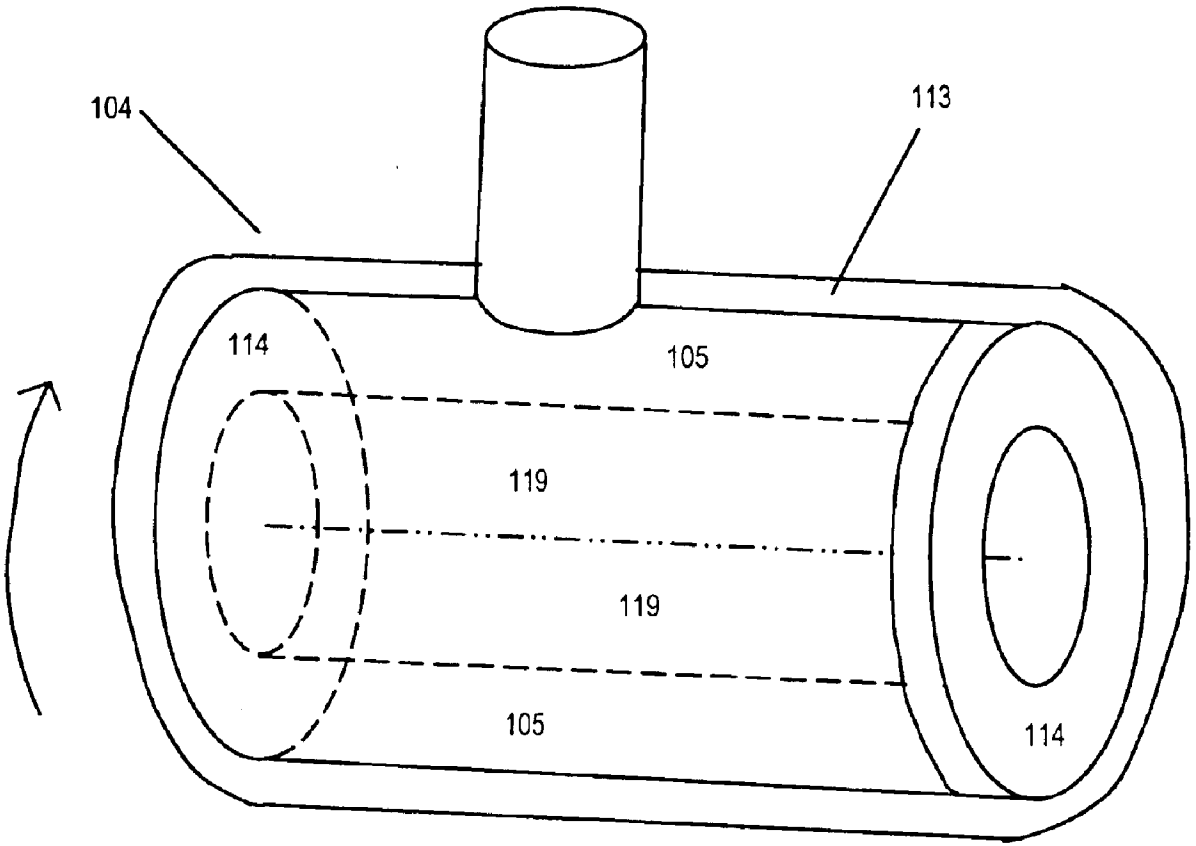
FIG. 3 shows a close-up of the spool valve of the phaser of FIG. 2.
Figure 6:
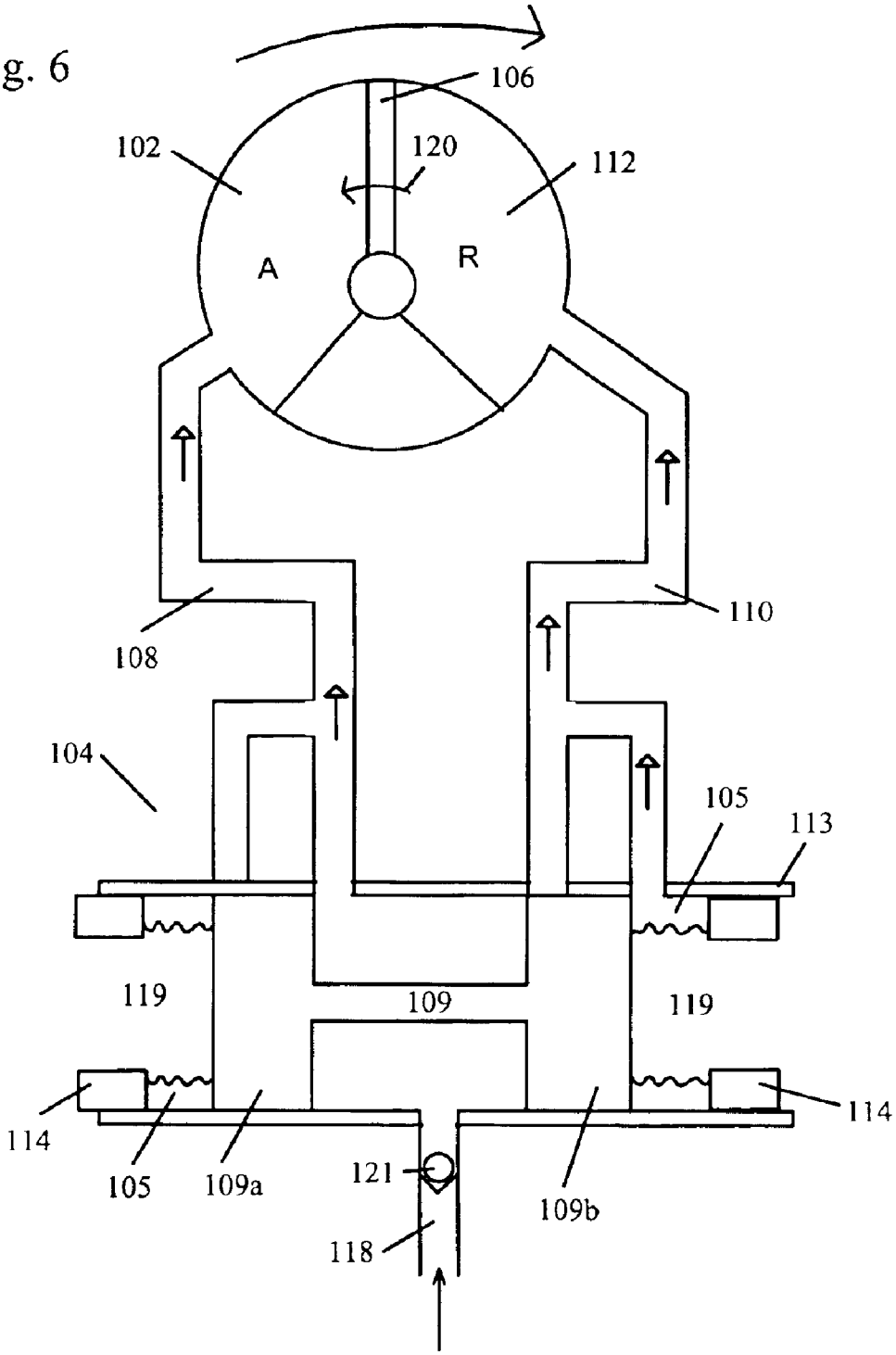
FIG. 6 shows a schematic of a single check valve torsion assist (TA) phaser with the oil ring of the first embodiment.
Figure 8:
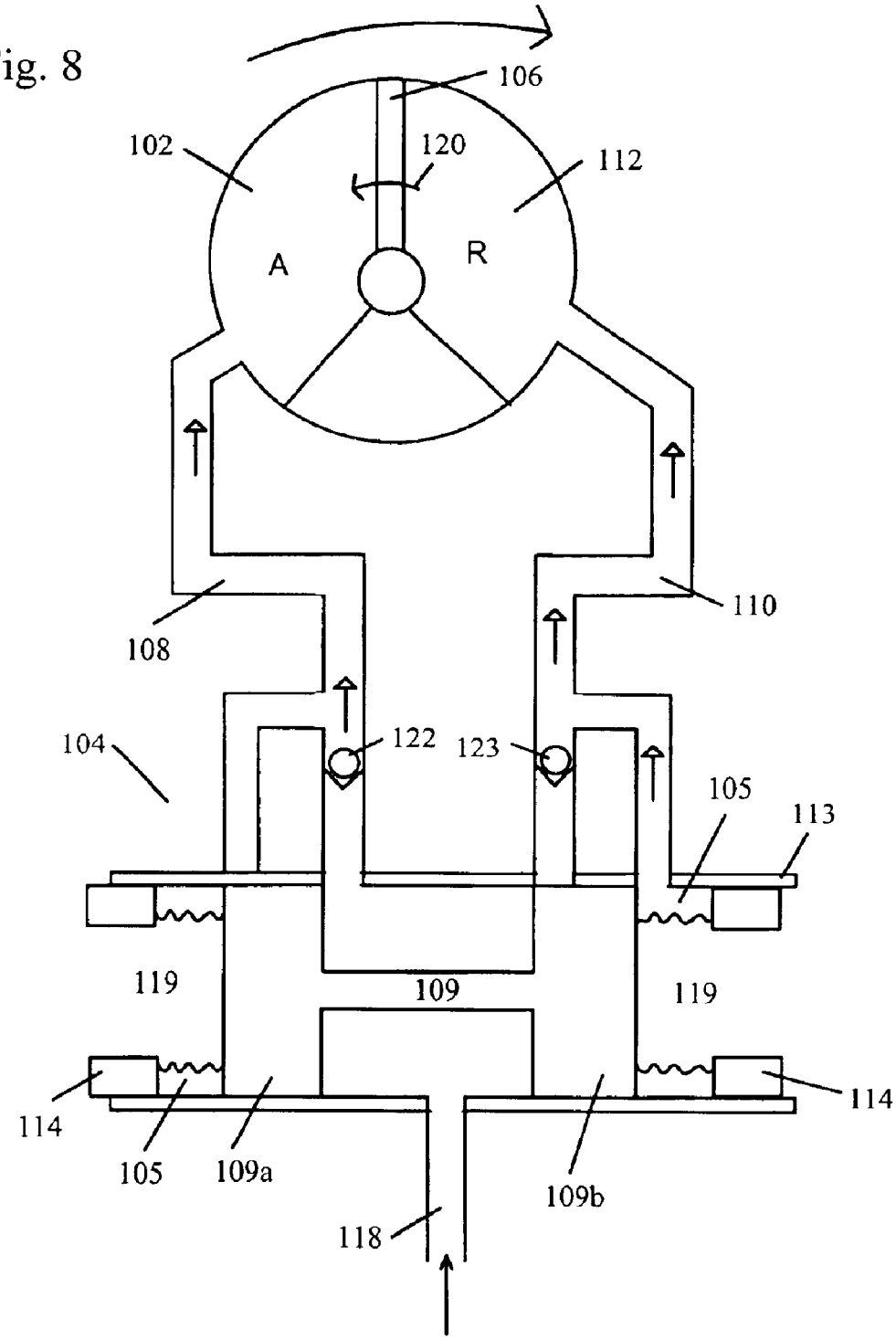
FIG. 8 shows a schematic of a two check valve torsion assist (TA) phaser with annular ring of the first embodiment.

As the spool valve 104 spins, shown in FIG. 3, (the spool has been omitted for clarity) oil 105 is forced by centrifugal effects to the outside walls of the cylindrical sleeve 113 between spool land 109*b* and annular ring 114 which acts as an oil dam and forms a ring-shaped reservoir. Air 119 remains in the center of the cylindrical recess 113. When a torque reversal 120 occurs, a small amount of oil pooling on the outside walls of the spinning valve is drawn into the chamber by the vacuum instead of air. By including annular rings 114 on either side of the spool valve 104, air is prevented from being drawn into the chamber 102, 112 regardless of whether the phaser is advancing or retarding. A hole is present in the annular ring 114 for excess oil to flow to sump (not shown). The above embodiment may also be used in torsion assist (TA) phaser with a check valve 121 in the supply line as shown in FIG. 6 or two check valves 122, 123, in each passage 108, 110 as shown in FIG. 8.

Figure 4:
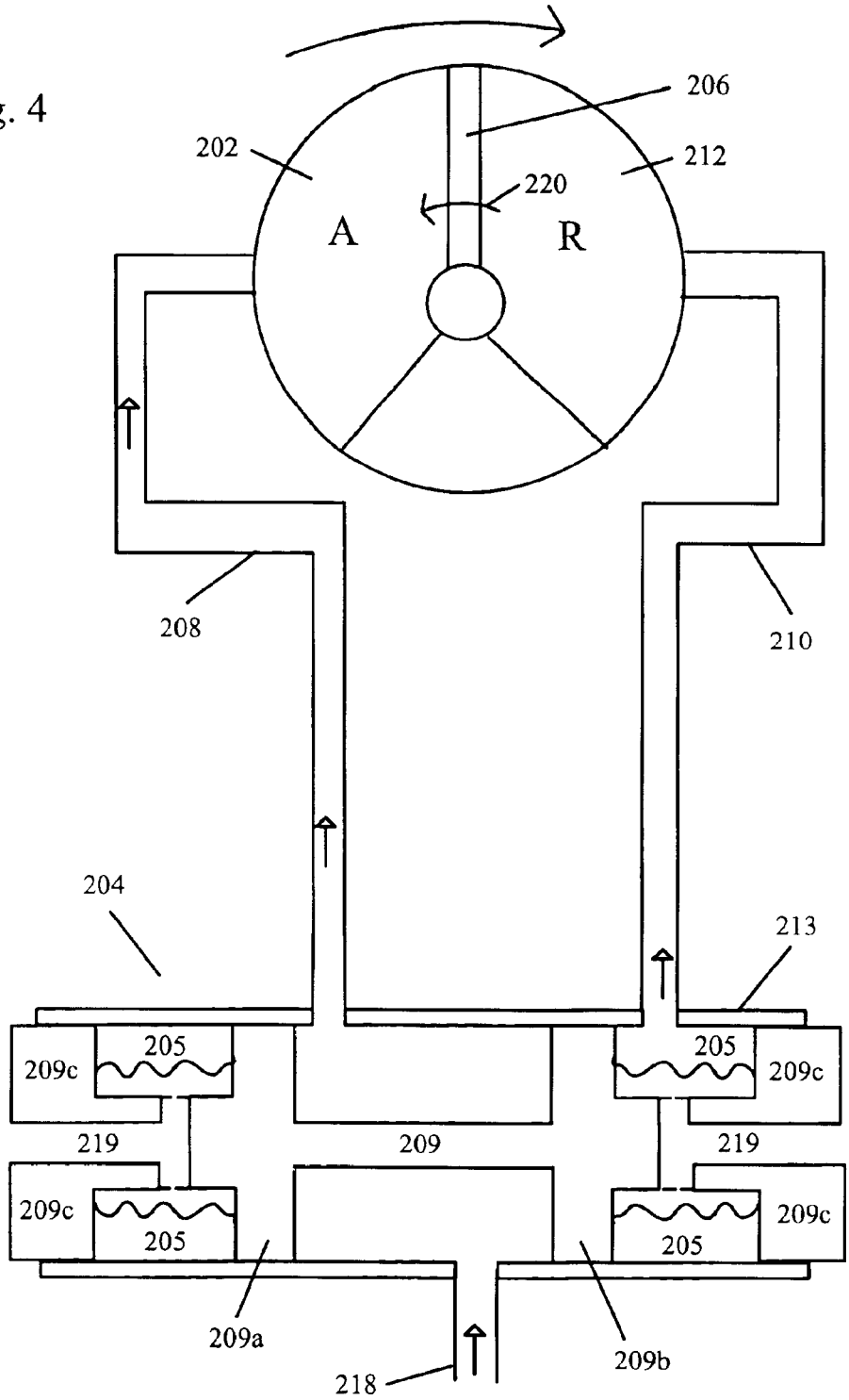
FIG. 4 shows a schematic of a phaser of the second embodiment.

FIG. 4 shows an oil pressure actuated (OPA) phaser of a second embodiment in the advance position. Supply line 218 provides oil 205 to line 208, which leads to advance chamber 202, and moves vane 206 in the direction shown by the arrow. Fluid 205 exits from the retard chamber 212 through line 210 to the spool valve 204. The spool valve 204 is comprised of a spool 209 and cylindrical lands 209*a*, 209*b*, and 209*c*. The cylindrical lands 209*c* are located on either side of the spool 204 and have a central hole in which oil may drain to sump (not shown). The spool 204 is biased on one side by a spring and an actuator on the other side (not shown).

Figure 5:
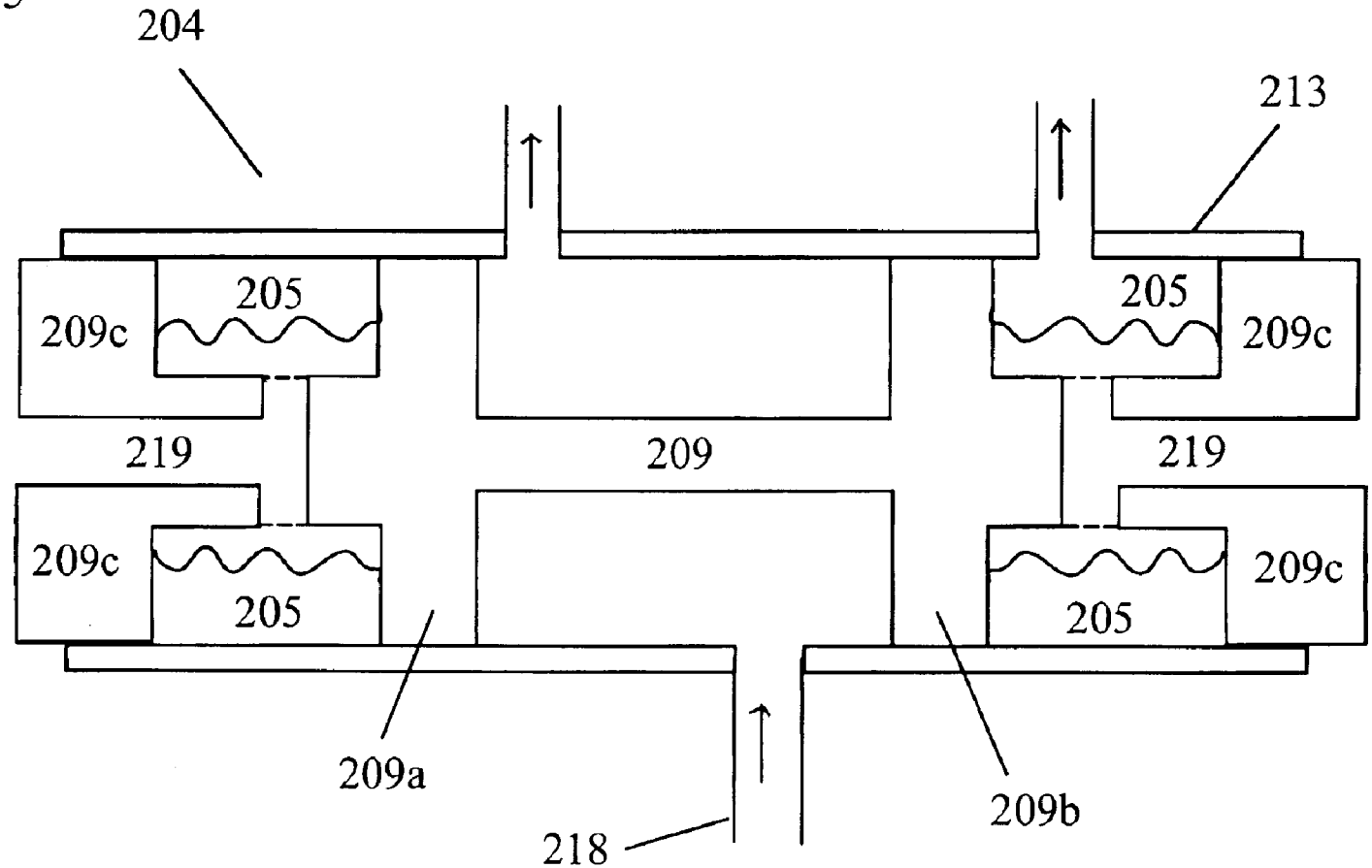
FIG. 5 shows a close-up schematic of the spool of the phaser in FIG. 4.
Figure 7:
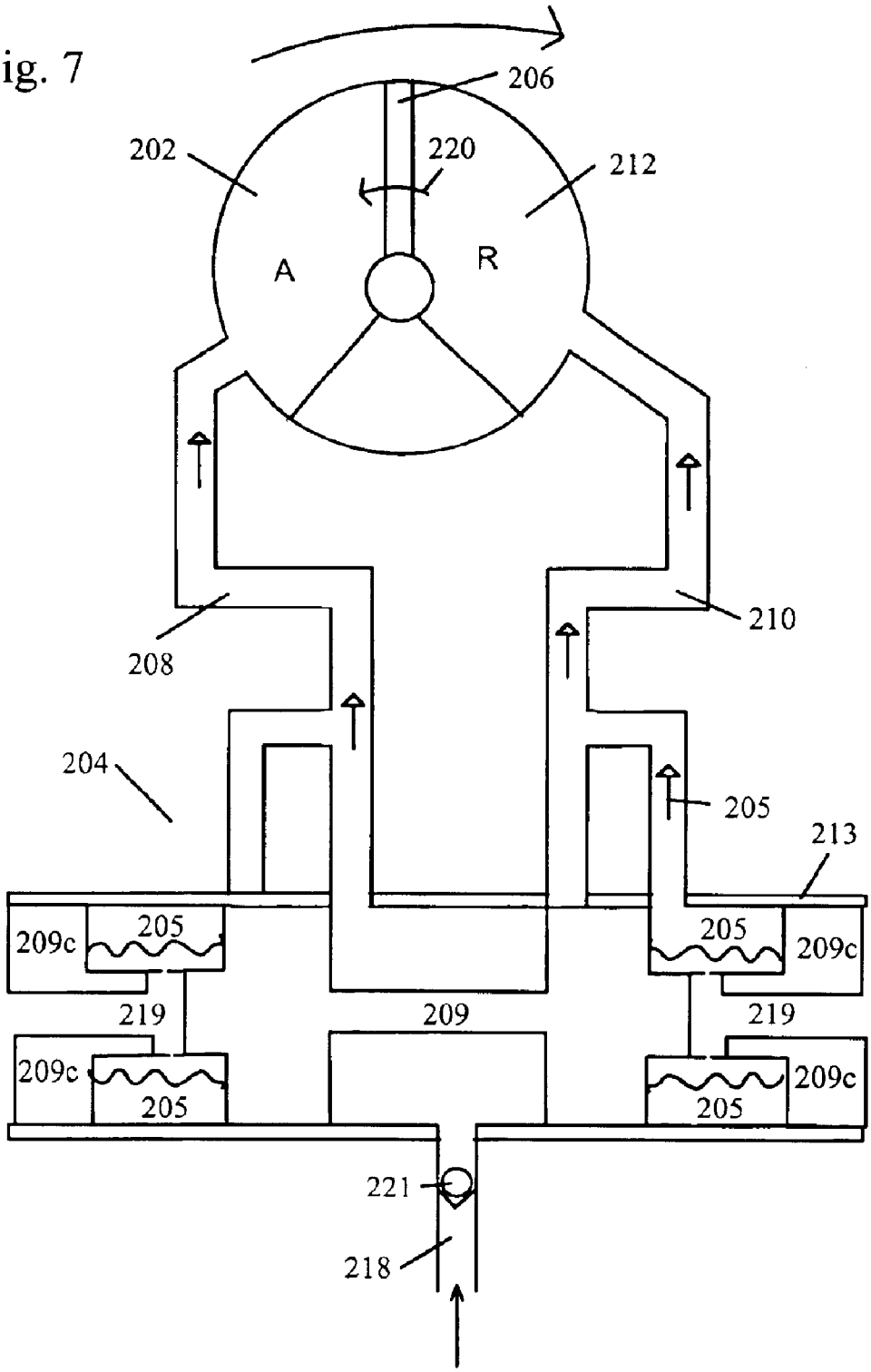
FIG. 7 shows a schematic of a single check valve torsion assist (TA) phaser with the additional spool land of the second embodiment.
Figure 9:
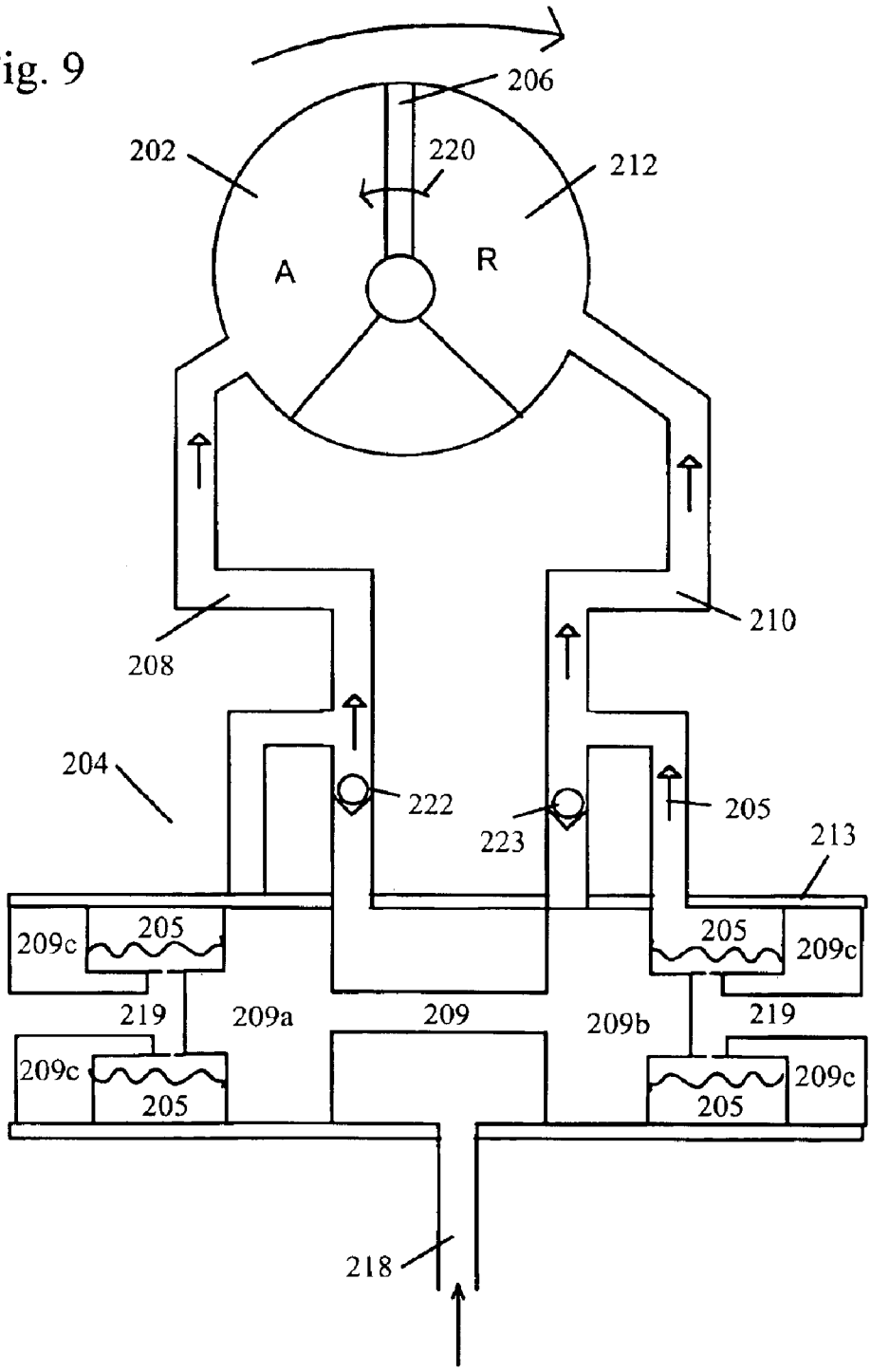
FIG. 9 shows a schematic of a two check valve torsion assist (TA) phaser with the additional spool land of the second embodiment.

As the spool valve spins, oil 205 is forced by centrifugal effects to the outside walls of the cylindrical sleeve 213 between spool land 209*b* and 209*c* as shown in FIG. 5. Spool lands 209*c* act as oil dams and form a ring-shaped reservoir of oil. Air 219 remains in the center of the cylindrical recess 213 between lands 209*b* and 209*c* and in the center of land 209*c*. When a torque reversal occurs 220, a small amount of oil pooling on the outside inner walls of the spinning valve 204 is drawn into the chamber 212 by the vacuum instead of air. By including the extra land 209*c* on either side of the spool valve 204, air is prevented from being drawn into the chamber 202, 212 regardless of whether the phaser is advancing or retarding as shown in FIG. 5. The above embodiment may also be used in torsion assist (TA) phaser with a check valve 221 in the supply line as shown in FIG. 7 or with two check valves 222, 223 in passages 208, 210 respectively as shown in FIG. 9.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine with at least one camshaft comprising:

a housing having an outer circumference for accepting drive force;

a rotor for connection to a camshaft, coaxially located within the housing, the housing having at least one chamber and the rotor having at least one vane dividing the chamber into at least one advance chamber and a retard chamber, the vane being capable of rotation to shift the relative angular position of the housing and the rotor;

a spool valve comprising a spool having a plurality of lands slidably mounted within a bore in the rotor, the spool in fluid communication with a supply of hydraulic fluid;

a plurality of passages connecting the advance chamber and the retard chamber to the spool valve; and a ring-shaped reservoir defined within the bore by an oil dam and at least one of the spool lands;

wherein the spool has a first position in which the advance chamber or the retard chamber is in fluid communication with the supply of hydraulic fluid and the other chamber is exhausting hydraulic fluid to the ring-shaped reservoir and a second position in which the advance chamber or the retard chamber is in fluid communication with the supply of hydraulic fluid and the other chamber is in fluid communication with the ring-shaped reservoir, such that when a torque reversal occurs, hydraulic fluid pooled in the ring-shaped reservoir is drawn into the advance chamber or retard chamber when the spool is in the second position.

2. The variable cam timing phaser of claim 1, wherein the oil dam is an annular ring.

3. The variable cam timing phaser of claim 2, wherein the annular ring is in an end of the bore.

4. The variable cam timing phaser of claim 2, wherein the annular ring is in a first end and a second end of the bore.

5. The variable cam timing phaser of claim 1, wherein the oil dam is an extra spool land located outward of the plurality of lands comprising an exhaust hole.

6. The variable cam timing phaser of claim 5, wherein the extra spool land is in an end of the bore.

7. The variable cam timing phaser of claim 5, wherein the extra spool land is in a first end and a second end of the bore.

8. The variable cam timing phaser of claim 1, further comprising a check valve in the supply of hydraulic fluid.

9. The variable cam timing phaser of claim 1, wherein the hydraulic fluid is oil.

10. The variable cam timing phaser of claim 1, further comprising check valves in the plurality of passages connecting the advance chamber and the retard chamber to the spool valve.

11. A variable cam timing phaser for an internal combustion engine with at least one camshaft comprising:

a housing having an outer circumference for accepting drive force;

a rotor for connection to a camshaft, coaxially located within the housing, the housing having at least one chamber and the rotor having at least one vane dividing the chamber into at least one advance chamber and a retard chamber, the vane being capable of rotation to shift the relative angular position of the housing and the rotor;

a spool valve comprising a spool having a plurality of lands slidably mounted within a bore in the rotor, the spool in fluid communication with a supply of hydraulic fluid;

a plurality of passages connecting the advance chamber and the retard chamber to the spool valve; and a ring-shaped reservoir defined within the bore by an oil dam and at least one of the spool lands;

wherein the spool has a position in which the advance chamber or the retard chamber is in fluid communication with the supply of hydraulic fluid and the other chamber is exhausting hydraulic fluid to the ring-shaped reservoir, such that when a torque reversal occurs, hydraulic fluid pooled in the ring-shaped reservoir is drawn into the advance chamber or retard chamber when the spool is in the position.

12. The variable cam timing phaser of claim 11, wherein the oil dam is an annular ring.

13. The variable cam timing phaser of claim 12, wherein the annular ring is in an end of the bore.

14. The variable cam timing phaser of claim 11, wherein the annular ring is in a first end and a second end of the bore.

15. The variable cam timing phaser of claim 11, wherein the oil dam is an extra spool land located outward of the plurality of lands comprising an exhaust hole.

16. The variable cam timing phaser of claim 15, wherein the extra spool land is in an end of the bore.

17. The variable cam timing phaser of claim 15, wherein the extra spool land is in a first end and a second end of the bore.

18. The variable cam timing phaser of claim 11, further comprising a check valve in the supply of hydraulic fluid.

19. The variable cam timing phaser of claim 11, wherein the hydraulic fluid is oil.

20. The variable cam timing phaser of claim 11, further comprising check valves in the plurality of passages connecting the advance chamber and the retard chamber to the spool valve.

* * * * *